US007055517B1

(12) United States Patent
Kitahara

(10) Patent No.: US 7,055,517 B1
(45) Date of Patent: Jun. 6, 2006

(54) BLOCK WORKING BLADE UNIT, BLOCK CHIPPING MACHINE AND BLOCK CHIPPING PROCESS

(75) Inventor: Tetsugoro Kitahara, Okayama (JP)

(73) Assignee: Tiger Machine Co., Ltd., Takahashi (JP)

( * ) Notice: Subject to any disclaimer, the term of this patent is extended or adjusted under 35 U.S.C. 154(b) by 0 days.

(21) Appl. No.: 11/000,310

(22) Filed: Nov. 30, 2004

(51) Int. Cl.
*B28D 1/32* (2006.01)

(52) U.S. Cl. ..... 125/23.01; 451/41

(58) Field of Classification Search ..... 451/41, 451/44, 27; 125/23.01
See application file for complete search history.

(56) References Cited

U.S. PATENT DOCUMENTS

| | | | | |
|---|---|---|---|---|
| 4,483,226 | A * | 11/1984 | Costarelli | 83/425.3 |
| 5,292,079 | A * | 3/1994 | Zakohji | 241/264 |
| 6,488,063 | B1 * | 12/2002 | Seymour | 144/338 |
| 2003/0221535 | A1 * | 12/2003 | Kraus et al. | 83/686 |

FOREIGN PATENT DOCUMENTS

| | | |
|---|---|---|
| JP | 01-156010 | 6/1989 |
| JP | 2000-301523 | 10/2000 |
| JP | 2001-269920 | 10/2001 |

* cited by examiner

*Primary Examiner*—Jacob K. Ackun, Jr.
(74) *Attorney, Agent, or Firm*—Flynn, Thiel, Boutell & Tanis, P.C.

(57) ABSTRACT

A block working blade unit which has working blades disposed in the form of a lattice in order to perform chipping work on the upper surface corner parts of a plurality of workpiece blocks when these blocks are arranged side by side at equal intervals. In a block chipping machine containing a conveyor and a working frame, the block working blade is disposed under the vibrator and an elevator is disposed below the block working blade unit to raise and lower the workpiece blocks toward the working blades. In order to perform the chipping process, the workpiece blocks lined up on a molding pallet are conveyed under the block working blade unit by the conveyor in the working frame and raised toward the working blades by the elevator. The present invention facilitates the replacement of working blades appropriately selected in accordance with the size of the workpiece blocks, and the replacement of worn working blades. Furthermore, chipping work of work piece blocks can be performed in a short time and the worked blocks can be conveyed into a stacking machine without rearranging the worked concrete blocks by manual labor or the like, by incorporating the chipping machine into a production line.

2 Claims, 6 Drawing Sheets

BLOCK WORKING BLADE UNIT, BLOCK CHIPPING MACHINE AND BLOCK CHIPPING PROCESS

BACKGROUND OF THE INVENTION

1. Field of the Invention

The present invention relates to a block working blade unit, a block chipping machine and a block chipping process which are incorporated into a block production line, and which are used to work the upper surface corner parts of blocks in a short time.

2. Description of the Related Art

Conventionally, mainly tumblers have been used as means for working the corner parts of concrete blocks and the like. Ordinarily, in such tumblers, a cylindrical rotating body with a length of 3 to 6 meters is disposed at an inclination. The working of concrete blocks using such a tumbler is accomplished by putting into the tumbler concrete blocks that are conveyed by means of a conveyor or the like via the feed-in opening of the tumbler, which is disposed in a location that is higher than the discharge opening, and rotating the tumbler. The surfaces of the concrete blocks are roughly chipped off or scrapped away by mutual contact inside the rotating tumbler. Concrete blocks whose end portions have been roughly chipped off are discharged from the discharge opening of the tumbler.

In the case of such a process, since the corners are chipped or cut away by causing the concrete blocks to contact each other inside the rotating tumbler, a considerable working time is required; furthermore, the worked concrete blocks are discharged from the discharge opening without being arranged in a row. Since the worked concrete blocks are ordinarily shipped after being stacked, it is necessary to line up the concrete blocks following working, and to convey these concrete blocks to a stacking machine. Accordingly, in cases where a conventional chipping process using a tumbler is used, a process in which the concrete blocks discharged from the tumbler are rearranged for the stacking machine by hand is required.

Furthermore, there have also been methods in which concrete blocks lined up on a conveyor are conveyed "as is", and the surfaces of these concrete blocks are worked by a chipping machine. For example, such methods include shot blast working (e.g., see Japanese Patent Publication No. 1-156010A) and methods in which a high-pressure water current or air stream is caused to jet onto the worked surfaces (e.g., see Japanese Patent Publication No. 2001-269920A and Japanese Patent Publication No. 2000-301523. However, these methods suffer from problems in terms of precision and increased size of the apparatus. Furthermore, in the case of methods that cause the jetting of a water current or air stream, it is difficult to achieve a worked surface with a feeling of natural rough chipping on the blocks by surface working.

In addition, there are also methods in which the surfaces of concrete blocks are worked using bush hammers or connected nail-form projections. In the case of such methods, however, it is difficult to chip only the upper surface corner parts of the concrete blocks. Moreover, in cases where the upper surface corner parts of blocks are worked using the nail-form projections, after the long sides of the corner parts or short sides of the corner parts of the blocks are worked, it is necessary to work the other sides of the corner parts again after rotating the blocks 90°.

SUMMARY OF THE INVENTION

The present invention was made in order to eliminate the above-mentioned drawbacks encountered in the prior art; it is an object of the present invention to allow a natural rough chipping or rough cutting of the upper surface corner parts of the blocks. Furthermore, it is also an object of the present invention to allow simple selection of working blades in accordance with the size of the concrete blocks, and simple replacement of worn working blades.

Furthermore, it is still another object of the present invention to perform chipping of the upper surface corner parts of concrete blocks in a short time with the concrete blocks lined up "as is", and to incorporate the chipping machine into a production line so that the concrete blocks following working can be conveyed to a stacking machine without arranging these concrete blocks by manual labor or the like.

In order to solve the abovementioned problems, the present invention has the following constructions.

(1) A block working blade unit which has working blades disposed in the form of a lattice in order to perform chipping work on the upper surface corner parts of a plurality of workpiece blocks when these blocks are arranged side by side at equal intervals.

(2) A block chipping machine comprising:

a conveyor for conveying workpiece blocks that are lined up on a molding pallet; and a working frame that is disposed at an intermediate point on the conveyor; wherein a vibrator is attached to the working frame, a block working blade unit is disposed under a main body of the vibrator, the block working blade unit has working blades arranged in the form of a lattice so as to perform chipping work on the upper surface corner parts of the respective workpiece blocks, and an elevator that is used to raise and lower the workpiece blocks toward the working blades is disposed just under the block working blade unit.

(3) A block chipping process, comprising:

conveying workpiece blocks that are lined up on a molding pallet by a conveyor;

feeding the workpiece blocks into a working frame via a feed-in opening;

temporarily stopping a vibrator attached to the working frame and the workpiece blocks on a table disposed just under a block working blade unit which is disposed under said vibrator main body and which has working blades arranged in the form of a lattice in order to perform chipping work on the upper surface corner parts of the workpiece blocks;

raising the workpiece blocks toward the working blades by an elevator;

performing chipping work on the upper surface corner parts of the workpiece blocks by the working blades under application of vibrations and then lowering the table; and feeding out the workpiece blocks via a feed-out opening in the working frame.

BRIEF DESCRIPTION OF THE DRAWINGS

FIG. 1(*b*) is a side view of the same.

DESCRIPTION OF THE PREFERRED EMBODIMENTS

Below, the present invention will be described in terms of embodiments shown in the attached figures.

(Block Working Blade Unit)

Figure 1:
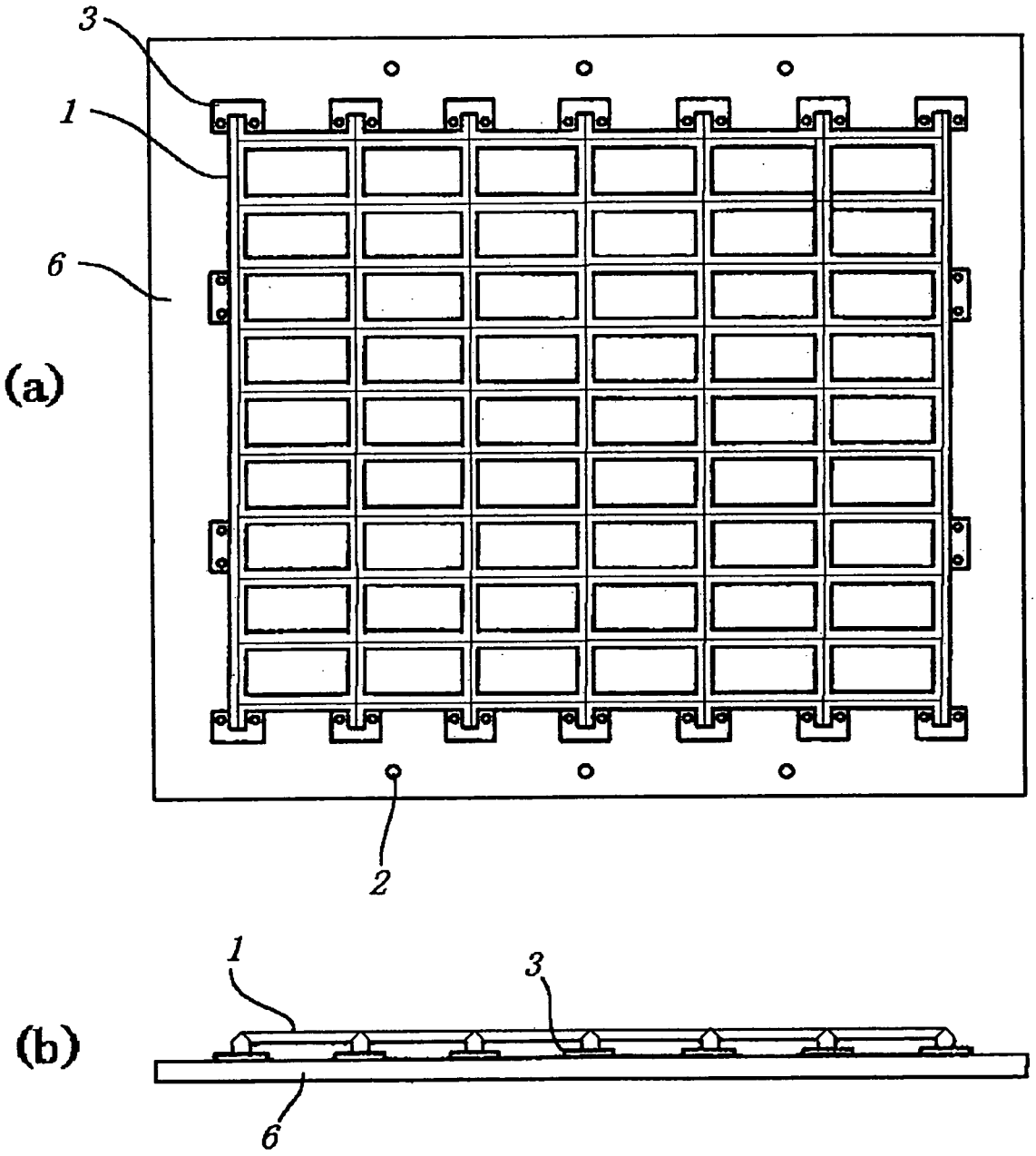
FIG. 1(*a*) is a plan view which shows one example of the block working blade unit of the present invention.

FIG. 1 (*a*) is a plan view showing one example of the block working blade unit of the present invention, and FIG. 1 (*b*) is a side view of the same.

Such a block working blade unit 1 was manufactured by welding a plurality of single-edged deformed bars as working blades in the form of a lattice. 3 indicates brackets; these brackets attach the block working blade unit 1 to a blade attachment plate 6 or a main body 11 of a vibrator via bolts or the like. As is shown in the side view, the tips of the working blades are formed in substantially the same plane. The working blade tips may be continuously connected overall as shown in the figures, or may be formed by disposing a plurality of nail-form projections. Furthermore, the working blades may be arranged in sets of adjacent two thereof so as to form a lattice. Furthermore, 2 indicates engaging holes for bolts or the like that are used when the blade attachment plate 6 is attached to the vibrator main body 11. It would also be possible to attach the block working blade unit 1 directly to the vibrator main body 11 without installing the blade attachment plate 6. Moreover, the method used to manufacture the block working blade unit 1 may be a method other than welding; for example, this blade unit 1 may be manufactured by integral molding.

Figure 2:
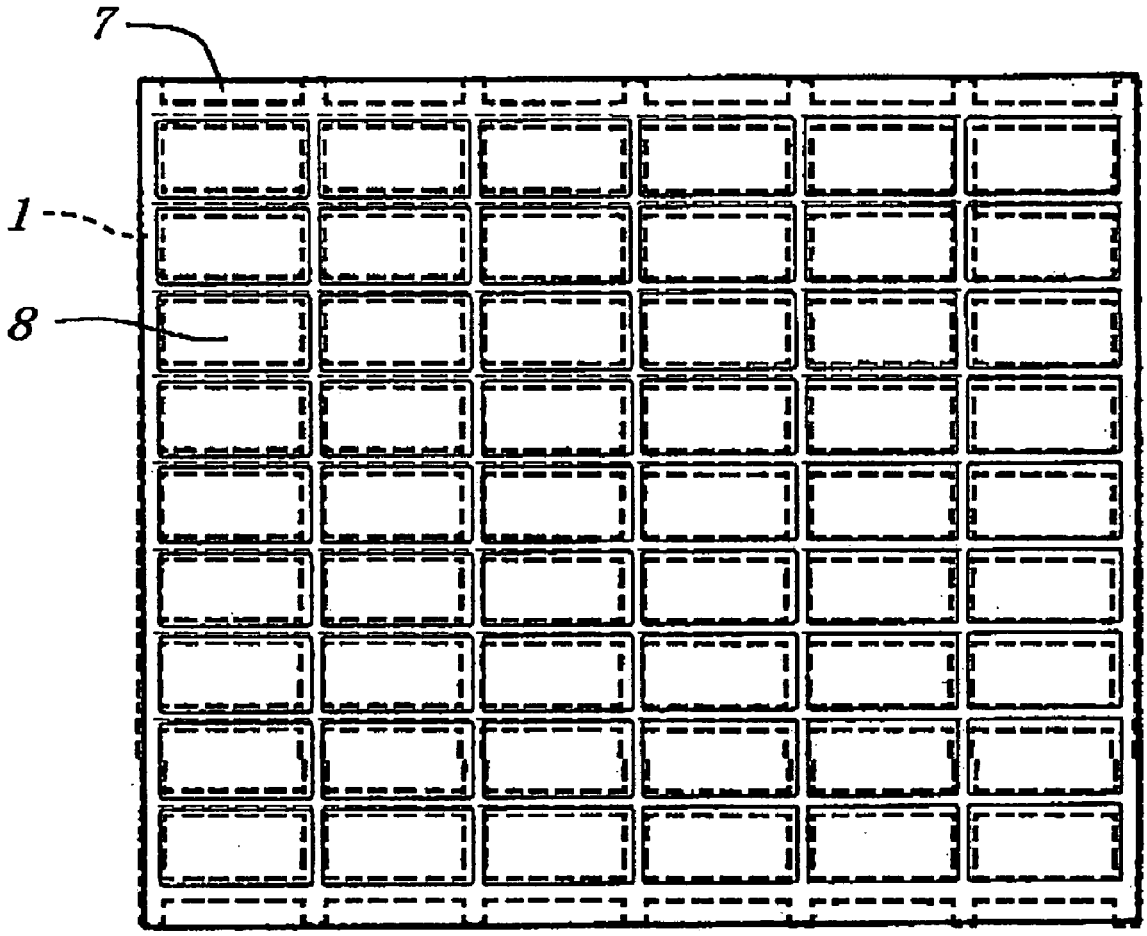
FIG. 2 is a plan view which shows the contact state of the block working blade unit and the workpiece blocks lined up on the molding pallet.

FIG. 2 is a plan view which shows the contact state of the block working blade unit 1 (broken line portions) and the workpiece blocks 8 (solid line portions) lined up on the molding pallet 7. As is shown in FIG. 2, the gaps between the individual working blades of the block working blade unit 1 are designed so that the blades contact the upper surface corner parts of the workpiece blocks 8.

(Block Chipping Machine)

Figure 3:
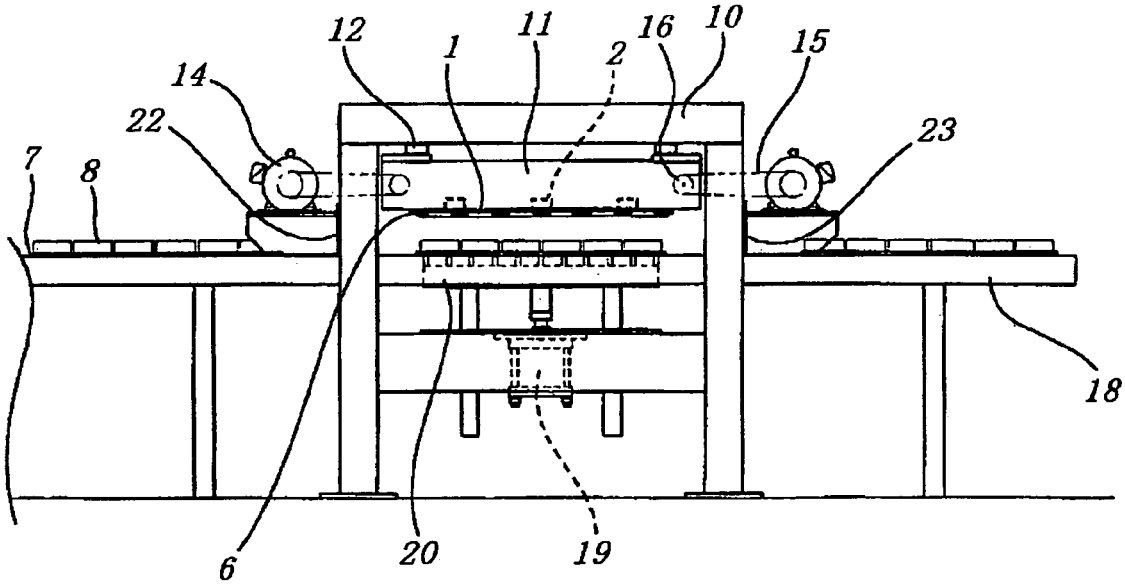
FIG. 3 is a front view which shows one example of the block chipping machine of the present invention.
Figure 4:
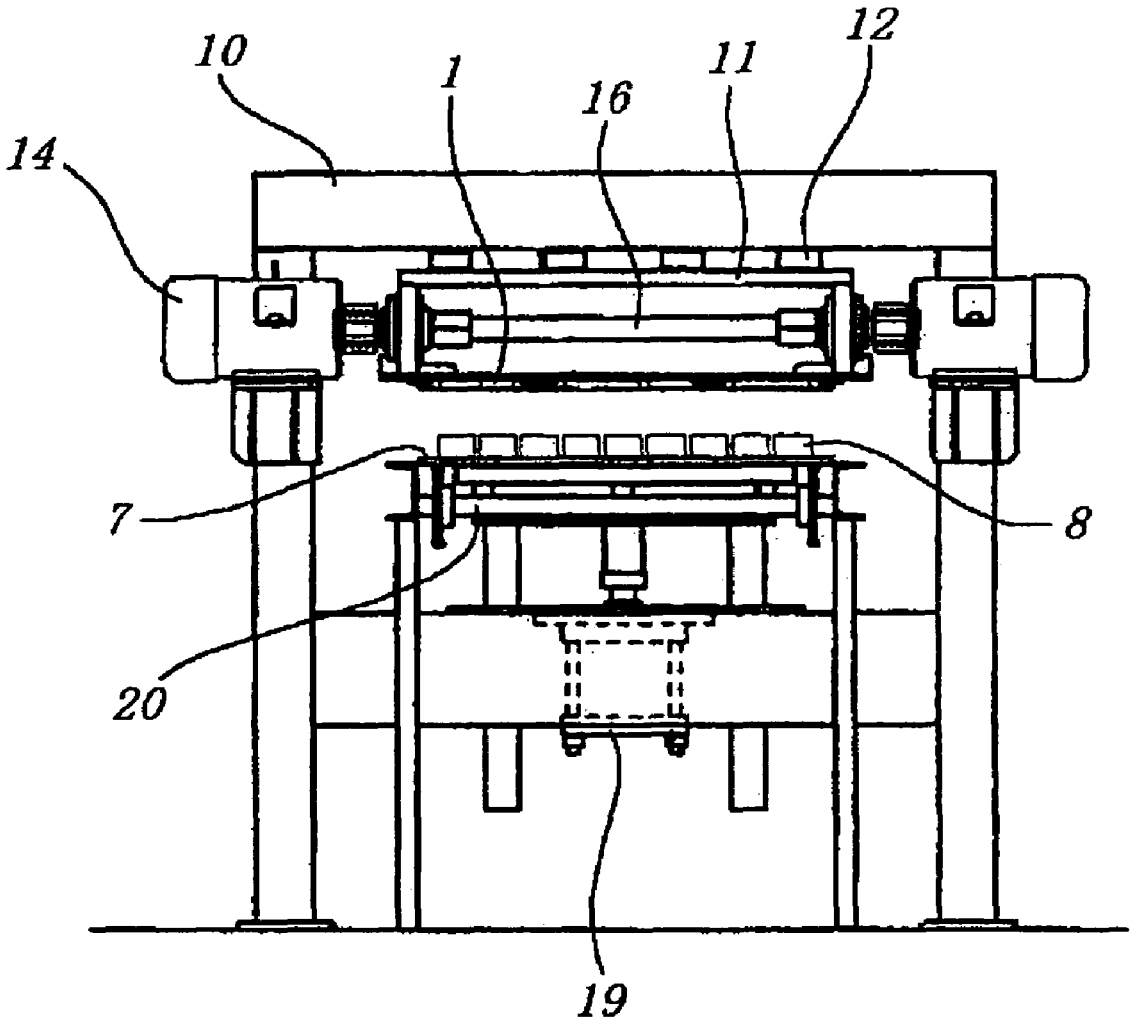
FIG. 4 is a side view which shows one example of the block chipping machine of the present invention.

FIGS. 3 and 4 are a front view and a side view which show one example of the block chipping machine. Common symbols are assigned to members that are the same as in FIGS. 1 and 2.

In the figures, 10 indicates the working frame of the chipping machine, and 11 indicates a vibrator main body. A blade attachment plate 6 to which a block working blade unit 1 is attached is fastened to the undersurface of the vibrator main body 11 by bolts or the like. Furthermore, 12 indicates shock absorbing members that are used to absorb the vibration of the vibrator main body 11, 14 indicates motors that are used to cause the vibrator main body 11 to vibrate, and 15 indicates endless V-belts that are mounted on V-belt pulleys 16. The workpiece blocks 8 are lined up beforehand on a molding pallet 7, and are conveyed by a conveyor 18. The workpiece blocks 8 advance into the working frame 10 via a feed-in opening 22, and stop on a table 20 that is positioned just under the block working blade unit 1 and raised and lowered by a cylinder 19. After the upper surface corner parts of the workpiece blocks 8 are worked by chipping, the workpiece blocks 8 are fed out from the working frame 10 via a discharge opening 23 by the conveyor 18.

(Block Chipping Process)

The workpiece blocks 8 are generally produced by being molded on a molding pallet 7 by means of a block molding machine or the like, conveyed by a conveyor or the like, and passing through a specified curing process.

Figure 5:
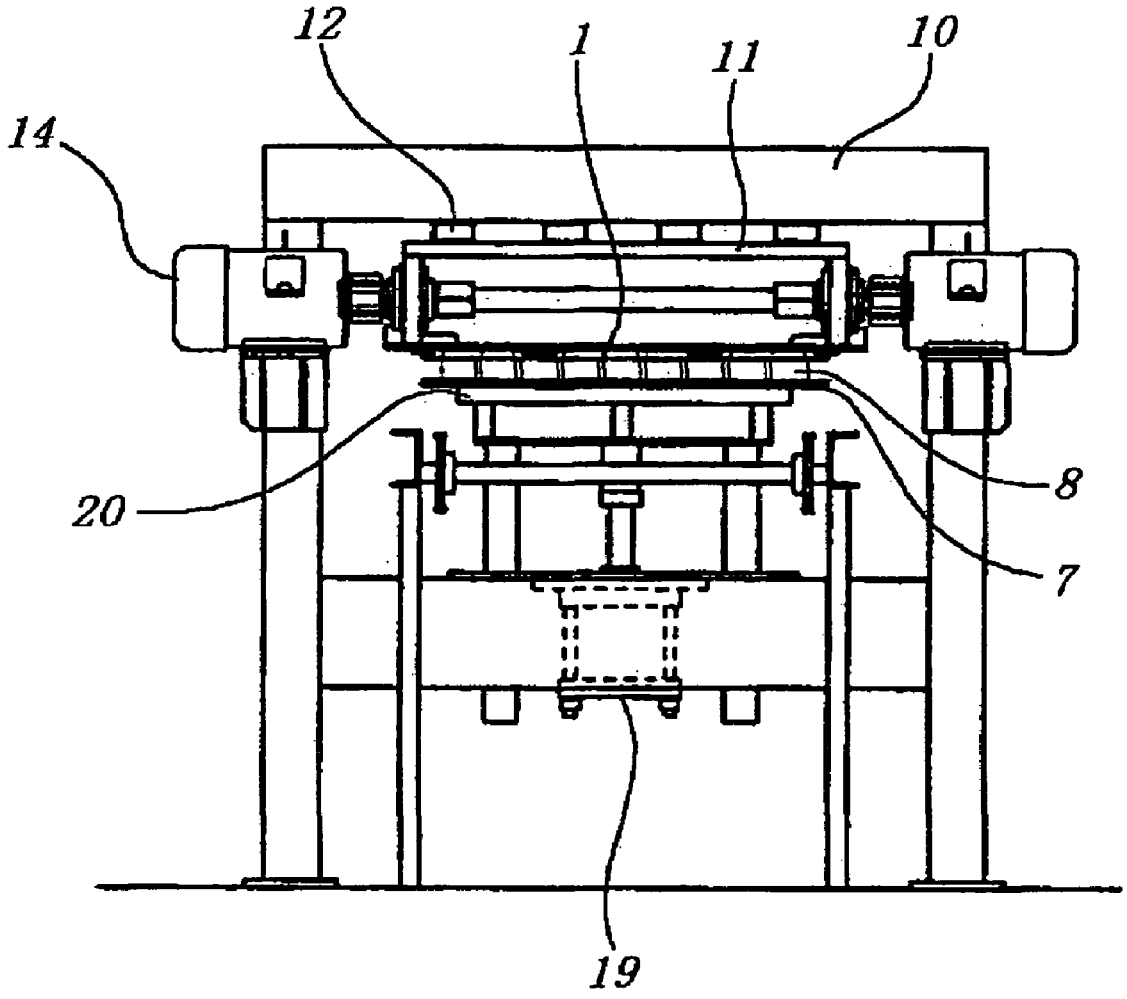
FIG. 5 is a side view showing a state in which the upper surface corner parts of the workpiece blocks contact the block working blade unit.
Figure 6:
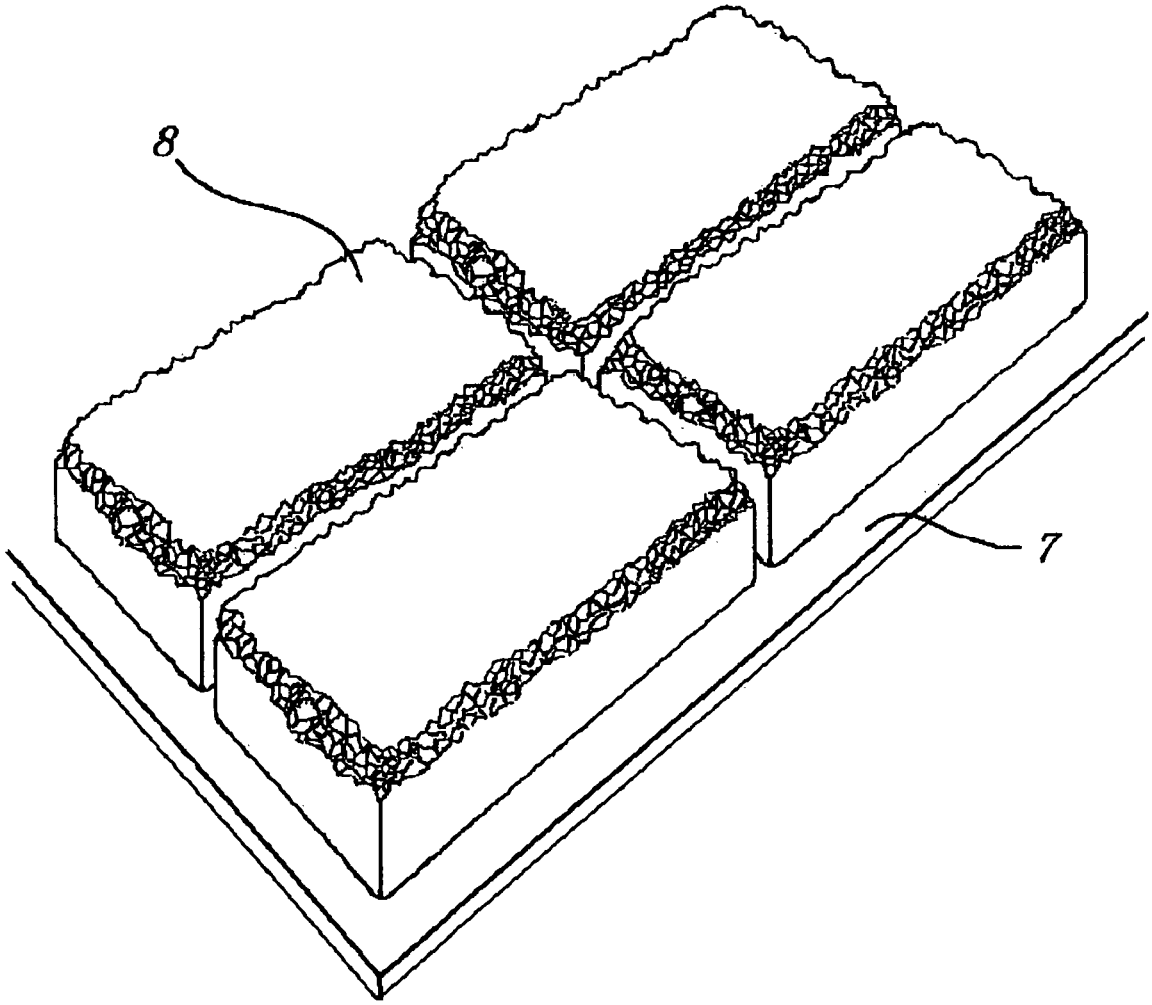
FIG. 6 is a perspective view which shows blocks following surface chipping.

The workpiece blocks 8 that have passed through the curing process are conveyed to the block chipping machine while still lined up on the molding pallet 7. The block chipping machine is constructed from a conveyor 18 and a working frame 10. The workpiece blocks 8 are conveyed into the working frame 10 via the feed-in opening 22, and stop on a table 20 that is positioned right under the block working blade unit 1 and raised and lowered by a cylinder 19. Subsequently, the cylinder 19 raises the workpiece blocks 8 that are placed on the table 20 along with the molding pallet 7. The upper surface corner parts of the raised workpiece blocks 8 contact the block working blade unit 1. FIG. 5 is a side view of the block chipping machine showing a state in which the upper surface corner parts of the workpiece blocks 8 contact the block working blade unit 1. The vibrator main body 11 to which the block working blade unit 1 is attached is caused to vibrate by the motors 14 or the like. Since the V-belts 15 are mounted on the V-belt pulleys 16 as shown in FIG. 3, the block working blade unit 1 is caused to vibrate eccentrically by the driving of the motors. The upper surface corner parts of the workpiece blocks 8 are roughly chipped off by the vibration of the block working blade unit 1, so that surface working with a natural feeling of rough chipping is performed. The upper surface corner parts of the workpiece blocks 8 following working are roughly chipped in a natural configuration as shown in FIG. 6. The workpiece blocks 8 that have been subjected to surface working are lowered by the cylinder 19, again placed on the conveyor 18, and discharged from the working frame 10 via the discharge opening 23. Since the workpiece blocks 8 are still placed on the molding pallet 7 after surface working, the blocks can be stacked "as is" by a stacking machine or the like.

The present invention has the merit of providing a block blade unit provided with working blades that can subject the upper surface corner parts of blocks to natural rough chipping.

Furthermore, the present invention also has the merit of providing a block chipping machine which allows the easy replacement of working blades appropriately selected in accordance with the size of the workpiece blocks, and the replacement of worn working blades.

Furthermore, the present invention has the merit of performing the chipping of blocks in a short time with the blocks lined up "as is", and allowing the conveying of such blocks into a stacking machine without rearranging the worked concrete blocks by manual labor or the like, by incorporating the chipping machine into a production line.

What is claimed is:

1. A block chipping machine comprising:

a conveyor for conveying workpiece blocks that are lined up on a molding pallet; and a working frame that is disposed at an intermediate point on said conveyor; wherein a vibrator is attached to said working frame, a block working blade unit is disposed under a main body of said vibrator, said block working blade unit has working blades arranged in the form of a lattice so as to perform chipping work on upper surface corner parts of the respective workpiece blocks, and an elevator that is used to raise and lower the workpiece blocks toward the working blades is disposed just under said block working blade unit.

2. A block chipping process, comprising:

conveying workpiece blocks that are lined up on a molding pallet by a conveyor;

feeding the workpiece blocks into a working frame via a feed-in opening;

temporarily stopping a vibrator attached to said working frame and the workpiece blocks on a table disposed just under a block working blade unit which is disposed under said vibrator main body and which has working blades arranged in the form of a lattice in order to perform chipping work on upper surface corner parts of the workpiece blocks;

raising the workpiece blocks toward said working blades by an elevator;

performing chipping work on the upper surface corner parts of the workpiece blocks by said working blades under application of vibrations and then lowering said table; and feeding out the workpiece blocks via a feed-out opening in said working frame.

* * * * *